United States Patent [19]

Swinton

[11] 4,247,967

[45] Feb. 3, 1981

[54] SLIP-RESISTANT BINDING

[75] Inventor: Walter C. Swinton, Columbia, S.C.

[73] Assignee: Excaliber, Incorporated, Atlanta, Ga.

[21] Appl. No.: 20,976

[22] Filed: Mar. 16, 1979

[51] Int. Cl.[3] ..... A43C 1/00; A43C 7/00

[52] U.S. Cl. ..... 24/143 R; 24/204

[58] Field of Search ..... 24/143 R, 143 B, 204

[56] References Cited

U.S. PATENT DOCUMENTS

| | | | |
|---|---|---|---|
| 3,059,518 | 10/1962 | Nelson | 24/143 R X |
| 3,205,544 | 9/1965 | Streule et al. | 24/73 |
| 3,327,410 | 6/1967 | Park, Sr. et al. | 36/2.5 |
| 3,522,637 | 8/1970 | Brumlik | 24/204 |
| 3,543,977 | 12/1970 | Lockridge | 248/444 X |
| 3,626,610 | 12/1971 | Dassler | 36/50 |
| 3,827,107 | 8/1974 | Moore | 24/204 X |
| 3,922,455 | 11/1975 | Brumlik | 24/204 X |
| 3,947,927 | 4/1976 | Rosenthal | 24/200 X |
| 3,947,928 | 4/1976 | Maldando | 24/143 R |
| 3,963,199 | 6/1976 | Pravaz | 244/148 |
| 3,994,048 | 11/1976 | Rosenthal | 24/204 X |
| 4,054,952 | 10/1977 | Swallow | 24/204 X |
| 4,065,834 | 1/1978 | Montague | 24/204 |
| 4,079,767 | 3/1978 | Howard | 150/3 |
| 4,081,916 | 3/1978 | Salisbury | 36/50 |

FOREIGN PATENT DOCUMENTS 557418 8/1932 Fed. Rep. of Germany .

*Primary Examiner*—Kenneth Downey

*Attorney, Agent, or Firm*—Lowe, King, Price & Becker

[57] ABSTRACT

A slip-resistant binding is formed by attaching male and female-type Velcro strips along opposite ends of a shoelace or other binding material. The two types of Velcro fasteners are arranged such that fasteners of opposite type automatically engage one another at every point where the lace or binding crosses. Alternatively, two strips of opposite-type Velcro material are joined back to back to form a slip-resistant binding.

9 Claims, 11 Drawing Figures

SLIP-RESISTANT BINDING

BACKGROUND OF THE INVENTION

The present invention relates to slip-resistant bindings and, more particularly, to a slip-resistant binding for use with shoes, boots, skates and the like.

It is well known that conventional shoe laces and bindings have an annoying tendency to loosen or come untied. Besides being annoying, such loosening can become dangerous when the person wearing the footwear is engaged in a vigorous activity, such as running, ice skating, or mountain climbing. In addition, small children and the handicapped can have great difficulty in retying a lace once it has come undone.

Ordinary laces readily loosen and come undone because they are formed of relatively smooth woven yarn materials. While the smooth surface of conventional laces allows the wearer to quickly lace and tie his or her shoelaces, the smooth surfaces of the lace provide little gripping power at the points where the lace crosses itself. Thus, only the inherent friction of the lace surface and the snugness of the knot formed by the wearer will determine the period of time which the knot will remain tied.

Various approaches have been taken to solve the problem of providing a secure, slip-resistant shoelace or binding. U.S. Pat. Nos. 4,071,964, 3,110,945, 3,639,481 2,306,515 and 2,141,801 disclose knots, beads, or raised areas provided along a shoelace at regular intervals. The purpose of these devices is to limit the extent to which the adjoining lace portions can slip with respect to each other. However, it is inherent in these designs that some slipping can occur. In addition, shoelaces of this type are expensive to produce.

U.S. Pat. Nos. 3,922,455, 3,522,637, 3,059,518 and German Pat. No. 557,418 disclose the use of a high friction surface or coating to achieve desirable slip-resistant properties. However, these laces require either a special coating step or the lace itself must be formed from a special type of yarn.

It is therefore an object of the invention to provide a slip-resistant binding, particularly for use with footwear.

It is an additional object to provide a slip-resistant binding which is readily adjustable.

It is a further object to provide a slip-resistant binding which is relatively inexpensive and easy to manufacture.

BRIEF SUMMARY OF THE INVENTION

These and other objects are achieved by the present invention wherein a slip-resistant binding is formed by attaching male and female-type (hook and loop) fastener strips along opposite ends or sides of a shoelace or other binding material. The two types of fasteners are arranged such that fasteners of opposite type automatically engage one another at every point where the lace or binding crosses. In a second embodiment, the two strips of opposite-type fasteners are joined back to back to form a slip-resistant binding. Alternatively, a cord of substantially circular cross-section is provided with fasteners of opposite type attached to opposite ends of the cord.

The male and female fastening means preferably are formed from Velcro or similar hook and loop fasteners known in the art. The use of Velcro, or the like, has several advantages. The male and female strips can be readily attached or sewn to a conventional shoelace in various patterns and in various lengths depending on the ultimate use for which the binding is intended. This type of fastener is readily sewn to itself or to other lacing materials.

A binding formed in accordance with the present invention is inherently slip-resistant. The male and female fasteners are arranged such that virtually every point where the lace or binding crosses itself will have fasteners or opposite type engaging one another. When used in a shoelace in which a bow-knot is tied, the plurality of points which cross and adjoin within the knot will have fasteners of opposite type engaged. The present invention also has the advantage of ease of lacing and tying since the fasteners of opposite type normally will not bind within the shoelace eyelets. Since only a relatively small portion of the fasteners are engaged at any crossover point during lacing, a certain degree of movement between the laces is afforded when the wearer tightens the laces. However, once tied, the normal (perpendicular) forces between the points where the laces cross will cause many more of the hook and loop fasteners to be engaged and thus resist slippage of the lace or the knot. This slipping resistance is of a degree which can be readily overcome by the wearer so that the binding can be undone. The binding, otherwise, is slip-resistant under normal conditions of use.

BRIEF DESCRIPTION OF THE DRAWING FIGURES

These and other advantages and features of the present invention are described in the following detailed description taken in connection with the following drawing figures wherein.

Figure 7A:
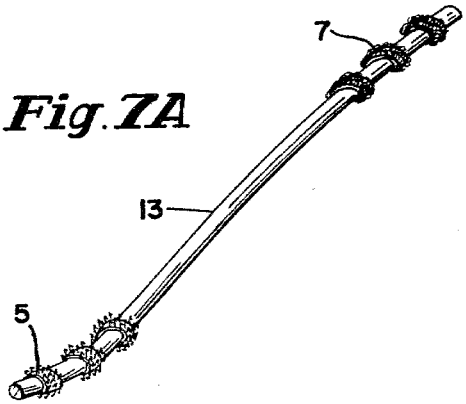
Figure 7B:
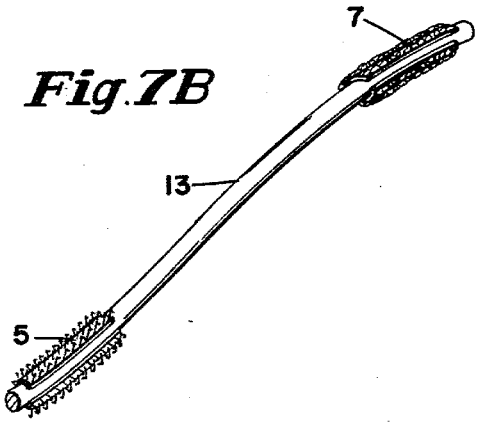

**FIGS. 7*a* and 7*b*** are perspective views of a third embodiment of the invention wherein the male and female fastening strips are attached to a cord or binding of circular cross section.

DESCRIPTION OF THE PREFERRED EMBODIMENTS

Figure 1:
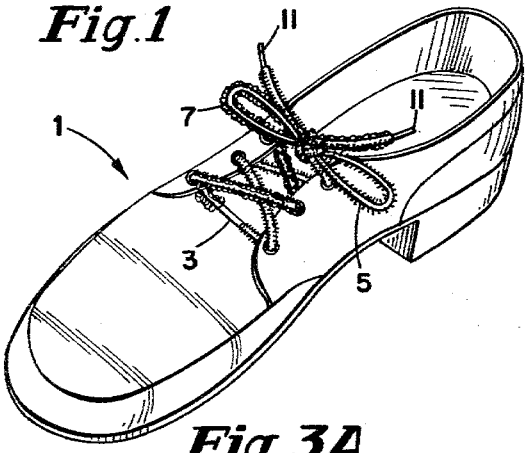
FIG. 1 is a perspective view of a shoe employing a slip-resistant binding formed in accordance with the principles of the present invention.
Figure 2A:
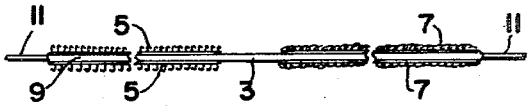
FIGS. 2–4 are cross-sectional side views of one embodiment of the invention in which various arrangements of the fastening means on the binding material are shown.
Figure 2B:
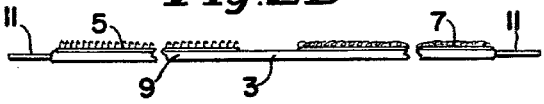
Figure 3A:
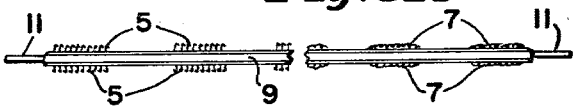
Figure 3B:
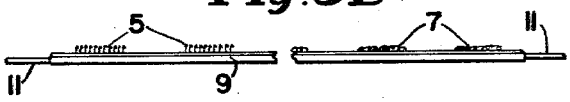

In FIG. 1, a shoe 1 is shown with a lace of binding 3 having male and female fastening means 5 and 7 attached thereto. Fastening means 5 and 7 respectively comprise strips of hook-type ("male") and loop-type ("female") fastener material. A typical fastening material is known under the trade name of Velcro and can be purchased in strips, sheets and other configurations. Other types of similar fastening means can be used in the practice of the invention. The two types of fasteners are readily engaged by pressing the complementary fabric units together. The fastener parts are disengaged by peeling the complementary portions apart. A well-known feature of Velcro-type fasteners is that they exhibit high shear strength when forces parallel to the engaging faces are applied, but relatively low normal or "peel" strength when forces substantially perpendicular to the engaging faces are applied. Thus, when two pieces of opposite type Velcro material are engaged, it takes a relatively large force to cause the two faces containing the hooks and loops to slip with respect to each other, compared to the strength needed to peel the pieces apart. The amount of forces needed to cause the pieces to slip or shear depends mainly on the number of hooks and loops engaged at the interface of the Velcro pieces. The number of hooks and loops engaged in turn depends on the surface area of each interfacing piece and the "tightness" or proximity of the two facing pieces.

In the present invention, as illustrated in FIG. 1, the Velcro-type strips of opposite (male and female) type which form the lace are arranged such that at a number of points where the laces cross, strips of opposite type will be disposed facing one another such that they are intimately engaged when the lace is tightened or knotted. Since only a relatively small area is presented at each cross-over point of the lace, the individual shear forces needed to overcome each of the fastener connections during lacing is small. Thus the two types of fasteners can move alone their interface, while individual hook and loop connections are broken and then reestablished. When lacing and knotting is completed, the hooks and loops engaged at each point where the lace crosses will prevent slipping of the laces, since the shear force needed to overcome the sum of all the lace fastener connections will be relatively high.

FIGS. 2–7 illustrate various embodiments of my invention. Shoelace 3 of FIG. 1 is shown in cross-section in FIG. 2A. A strip of binding material 9, which for instance can be a standard shoelace, has male-type fastener strip 5 and female type fastener strip 7 attached to opposite ends of binding material 9. The fasteners can be attached along both sides of lace material 9 as shown in FIG. 2A or along only one side of the lace material as illustrated in FIG. 2B. Various lengths of the strips of fastening material can be used depending on the use to which the lace is to be put. Shoelace tips 11 are applied to the ends of binding 9. In FIGS. 3A and 3B the fasteners are applied in discontinuous strips to the binding material, rather than as continuous strips as in FIGS. 2A and 2B.

Figure 4A:
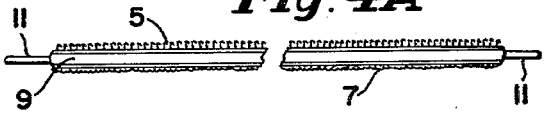
Figure 4B:
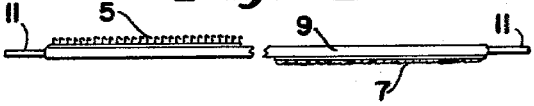

FIG. 4A illustrates an arrangement wherein fasteners of opposite type 5 and 7 are applied to opposite sides of binding material 9. In FIG. 4B fasteners 5 and 7 are shown attached to portions of opposite sides of binding material 9 but not along the entire length of the binding material.

Figure 5:
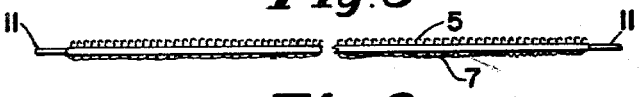
FIGS. 5 and 6 are cross-sectional side views of a second embodiment of the invention wherein the male and female fastening strips are joined together without an intermediate binding strip.
Figure 6:
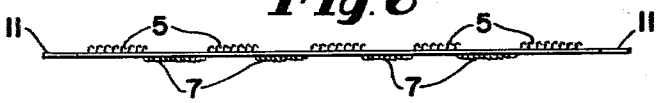

FIG. 5 illustrates a second embodiment of the invention in which the strips of male-type and female-type fasteners are joined directly together, without an intermediate binding strip as in FIGS. 2–4. Strips 5 and 7 are arranged having the fastening loops or hooks projecting from only one face or side thereof. The backs of strips 5 and 7 are relatively smooth. To form the binding of FIG. 5, strips 5 and 7 are bonded, sewn, or otherwise joined back-to-back along their length. In FIG. 6, strips of male-type and female type fasteners 5 and 7, respectively, are joined end to end to form a length of slip-resistant binding. The orientation and arrangement of the strips are a matter of choice.

Whereas FIGS. 2–4 show my invention as being used with a binding 9 of generally rectangular cross-section, FIGS. 7A and 7B illustrate a third embodiment of my invention as applied to cordage of generally circular cross-section. Cord 13 may, for example, be a round-type shoelace, a rope, or a similar binding material of circular cross-section. As shown in FIG. 7A, strips 5 and 7 of male-type and female-type fastening material, respectively, are wound in a spiral pattern around portions of opposite ends of cord 13 and joined thereto. The number and pitch of the turns provided are a matter of choice. Strips 5 and 7 of male-type and female-type fastening material can also be applied laterally to the surface of cord 13 as shown in FIG. 7B. The fastening strips of opposite type can be applied to opposite ends of cord 13 (as in FIG. 7B) or the strips can be intermixed in various patterns.

In each of the embodiments illustrated above the male-type and female-type fastening strips are joined to one another or to an intermediate binding strip or cord by means of bonding, sewing, or other methods well known in the art.

Thus, it can be seen that the present invention provides a simple slip-resistant binding useful as a shoelace or similar binding. Indeed, the present invention can be applied to a wide variety of bindings in any situation or environment where a slip-resistant binding is desired. While the slip-resistant binding of the present invention has been described in considerable detail, it is understood that various changes and modifications may occur to persons of ordinary skill in the art without departing from the spirit and scope of the invention as defined in the appended claims.

What is claimed is:

1. A slip resistant binding comprising a strip of material having first and second ends; a multiplicity of male, hook-shaped filamentary members distributed on opposite sides of said strip along a first substantial portion thereof adjacent the first end of said strip and a multiplicity of female, loop-shaped filamentary members distributed on opposite sides of said strip along a second substantial portion thereof adjacent the second end of said strip, said male filamentary members on said first strip portion and said female filamentary members on said second strip portion releasably interengaging each other at crossover points of said first and second strip portions.

2. A slip resistant binding comprising a first strip of material having first and second ends; second strips of material each having a substantially smooth back side and a front side formed with a multiplicity of male, hook-shaped filamentary members; third strips of material each having a substantially smooth back side and a front side formed with a multiplicity of female, loop-shaped filamentary members, said second and third strips of material being joined back to back to said first strip along a substantial portion thereof adjacent the first end of said first strip, said second and third strips of material being joined back to back to said first strip along a substantial portion thereof adjacent the second end of said first strip, said male filamentary members on said second strips releasably interengaging said female filamentary members on said third strips at crossover points of said second and third strips.

3. The binding of claim 13 or claim 2 wherein said male and female members are formed as discontinuous strips.

4. The binding of claim 1 or claim 2 wherein said strip comprises a shoelace.

5. The binding of claim 4 including tips formed on the ends of said shoelace.

6. A slip-resistant binding comprising a circular cross section cord having first and second ends, a multiplicity of male, hook-shaped filamentary members on a first portion of said cord adjacent the first end thereof; and a multiplicity of female, loop-shaped filamentary members on a second portion of said cord adjacent the second end thereof, the male members and female members releasably interengaging each other at crossover points adjacent the first and second ends of said cord.

7. The binding of claim 6 wherein said male and female members respectively are arranged in a spiral around said first and second portions of said cord.

8. The binding of claim 6 wherein said male and female members are arranged laterally around said first and second portions of said cord.

9. A slip resistant binding, comprising a strip of material having a multiplicity of male, hook-shaped filamentary members distributed throughout a substantial portion of one side of said strip and a multiplicity of female, loop-shaped filamentary members distributed throughout a substantial portion of an opposite side of said strip; said male filamentary members on said one side of said strip and said female filamentary members on said opposite side of said strip releasably interengaging each other at crossover points of opposite sides of said strip.

* * * * *